US007861486B2

(12) United States Patent
Hopkins

(10) Patent No.: US 7,861,486 B2
(45) Date of Patent: Jan. 4, 2011

(54) FLEXIBLE EXPANSION AND SEALING JOINT AND METHOD FOR USING THE SAME

(75) Inventor: John R. Hopkins, Bow Mar, CO (US)

(73) Assignee: Protecto Wrap Company, Denver, CO (US)

( * ) Notice: Subject to any disclaimer, the term of this patent is extended or adjusted under 35 U.S.C. 154(b) by 0 days.

(21) Appl. No.: 12/472,138

(22) Filed: May 26, 2009

(65) Prior Publication Data

US 2009/0229215 A1 Sep. 17, 2009

Related U.S. Application Data

(62) Division of application No. 11/426,536, filed on Jun. 26, 2006, now abandoned.

(51) Int. Cl.

| | |
|---|---|
| ***E04B 1/62*** | (2006.01) |
| ***E04B 1/00*** | (2006.01) |
| ***E04F 15/14*** | (2006.01) |
| ***E04C 2/38*** | (2006.01) |
| ***E04G 23/00*** | (2006.01) |

(52) U.S. Cl. ..... 52/745.21; 52/396.02; 52/741.4; 52/718.01; 52/716.4; 52/393; 29/458

(58) Field of Classification Search ..... 52/271–274, 52/293, 393.1, 393, 716.4, 718.04, 718.01, 52/718.03, 718.05, 98, 293.1, 741.4, 745.21, 52/287.1; 29/458, 527.1, 527.2, 525.15
See application file for complete search history.

(56) References Cited

U.S. PATENT DOCUMENTS

| | | | | |
|---|---|---|---|---|
| 2,111,922 | A * | 3/1938 | Borkenstein | 52/716.1 |
| 4,815,886 | A * | 3/1989 | Madsen | 403/28 |
| 5,091,235 | A * | 2/1992 | Vergnano | 428/192 |
| 5,333,432 | A * | 8/1994 | Schluter | 52/396.1 |
| 6,073,418 | A * | 6/2000 | Carroll | 52/746.11 |
| 6,578,332 | B2 | 6/2003 | Bushberger | |
| 7,254,894 | B1 * | 8/2007 | Halpert | 33/1 B |
| 2003/0070391 | A1 * | 4/2003 | Tachauer et al. | 52/745.21 |
| 2005/0252131 | A1 * | 11/2005 | Bushberger | 52/411 |

FOREIGN PATENT DOCUMENTS

| | | | |
|---|---|---|---|
| GB | 2405650 | A * | 3/2005 |

* cited by examiner

*Primary Examiner*—Brian E Glessner
*Assistant Examiner*—Omar Hijaz
(74) *Attorney, Agent, or Firm*—Marsh Fischmann & Breyfogle LLP

(57) ABSTRACT

An expansion joint and seal is provided that is adapted for adherence to a wall and floor interface. The joint is operative to seal the interface such that self-leveling materials cannot flow between the wall and the floor. When adhered to the interface, a compressive member may be disposed coincidental to the wall. This compressive member allows for expansion of solidified self-leveling materials relative to the wall. In one arrangement, the joint and seal utilizes a flexible sheet member having a bottom surface that is adapted for adherence to the interface of a wall and floor. A compressible member is attached to the top surface of the flexible sheet member. The bottom surface of the flexible sheet member may also include a peel-away release member that covers an adhesive disposed on the bottom surface.

10 Claims, 5 Drawing Sheets

FLEXIBLE EXPANSION AND SEALING JOINT AND METHOD FOR USING THE SAME

CROSS REFERENCE

This application is a divisional of U.S. patent application Ser. No. 11/426,536 having a filing date of Jun. 26, 2006 now abandoned.

FIELD OF THE INVENTION

The present invention relates broadly to expansion joints and methods for using such expansion joints. More particularly, the present invention relates to an expansion joint that is adapted to seal an interface between a wall surface and a floor surface to facilitate the application of one or more liquefied additives to the floor surface.

BACKGROUND OF THE INVENTION

During construction of various structures, e.g., the manufacture of residential and commercial housing, it is sometimes desirable to apply an additive to floor surfaces to facilitate leveling of those surfaces. These additives, for example self-leveling concretes and/or polymers, are typically applied in a liquefied/slurry form that allows the additive to find a common level prior to solidifying. Such additives may be applied in a layer that, when solidified, may be several inches thick.

As may be appreciated, to allow the additive to solidify as a level surface, it may be desirable or even necessary to prevent the liquefied additive from flowing though gaps at the interface of a wall and a floor. One known method for preventing such flow is to apply a strip of tape (e.g., duct tape) along the interface of the wall and floor. In this regard, a first portion of the width of a tape strip is applied to the wall surface and a second portion of the width of the tape strip is applied to the floor surface. Generally, the application of such a tape strip effectively seals the interface between the wall surface and floor surface to prevent flow of a liquefied additive there through.

While use of tape strip(s) effectively seals an interface between a wall surface and a floor surface, the use of such additives provides several additional challenges. For instance, the additives typically solidify into a continuous slab on the floor surface. However, the additive may have a different rate of thermal expansion than the underlying floor surface. That is, solidified additive may expand at a greater rate than underlying flooring. This may cause the solidified additive to flake and/or break at the interface(s) of the floor and wall(s). In addition, such expansion may cause the wall(s) to bow or otherwise damage the wall.

Another potential disadvantage of such self-leveling additives is the enhanced transmission of acoustic sound through the floor, which is especially evident in self-leveling concrete floors. Specifically, such floors may conduct sound from a first room to a second room. This may be particularly problematic when the sound is conducted between separate residences (e.g., adjacent apartments).

SUMMARY OF THE INVENTION

In view of the foregoing, it is an object with the present invention to provide methods and apparatuses for sealing the interface between a wall surface and a floor surface while permitting expansion of solidified additives applied to the floor surface as well as reducing acoustic transmission through such solidified additives to the wall surface. Accordingly, provided herein are various apparatuses and methods (i.e., utilities) that utilize a flexible sheet member that is adapted for adherence to the interface wall and floor. The flexible sheet member further includes a compressive member that is attached to a top surface thereof. This compressible member may be aligned substantially with the wall when the flexible sheet member is interconnected to the wall and floor.

According to a first aspect, a method for forming an expansion joint and seal for a wall/floor interface is provided. The method includes removing a peel-away release member from a first or bottom surface of an adhesive sheet member. A compressible member may then be oriented relative to a wall where the compressible member is attached to a second or top surface of the adhesive sheet member. Then the bottom surface of the adhesive sheet member may be adhered to the wall and the floor. The sheet member may thereby seal the interface between a wall and a floor while the compressible member is disposed coincidental to the wall.

Accordingly, adhering the bottom surface of the sheet member to the wall and floor may entail adhering a first portion of the sheet member to the floor and a second portion of the sheet member to the wall. In this regard, the sheet member may prevent solidified additives from flowing through an interface disposed between the wall and the floor. Accordingly, a flooring additive may be applied to the floor after the expansion joint is adhered thereto. Such a flooring additive may be allowed to cure into a solid surface, at which time portions of the flexible sealing joint disposed above the solid surface may be removed. As may be appreciated, the compressible member may allow for expansion of the solidified flooring additive, as well as provide acoustic break between the solidified flooring additive and the wall surface.

According to another aspect, a utility is provided for forming an expansion joint and seal for a wall/floor interface. The method includes positioning a sheet member having first and second surfaces (i.e., bottom and top surfaces) relative to the interface of a wall and a floor and adhering a first portion of the bottom surface to the floor, such that a compressible sheet member connected to the top surface of the sheet member is coincidental to the wall and transverse to the floor. The method may further include adhering a second portion of the bottom surface to the wall. Such adherence may be performed by manually applying an adhesive to the surface of the sheet member and/or the wall and floor. In an alternate arrangement, the sheet member may include an adhesive surface that may be exposed by, for example, removing a release sheet interconnected thereto. Further, first and second release sheets may be interconnected to the first and second portions of the sheet member to allow for individual removal of the individual sheets such that the first and second portions of the bottom surface may be individually applied to the floor and wall, respectively.

According to another aspect of the present invention, a method for forming an expansion joint and seal for a wall/floor interface is provided. The method includes positioning a sheet member having first and second surfaces relative to the interface of a wall and a floor. A first release sheet is removed from the first surface to expose an adhesive. First and second portions of this first surface are then applied to the floor and the wall, respectively. A second release sheet may then be removed from the second surface of the sheet member to expose an adhesive on that second surface. Once the adhesive is exposed on the second surface, a compressible member may be adhered thereto. Preferably, the compressible member is adhered such that it is coincidental to the wall and transverse to the floor. The present utility allows for interconnecting the compressible material and the sheet member on location.

According to another utility, an expansion and sealing joint is provided. The joint includes a flexible sheet member having a top surface and a bottom surface. An adhesive is associated with the bottom surface. A first portion of the bottom surface is adapted for adherence to a floor surface and a second portion of the bottom surface is adapted for adherence to a wall surface. A first release sheet covers at least a portion of the adhesive associated with the bottom surface. This release sheet may be selectively removed to expose the adhesive on the bottom surface of the flexible sheet member. Finally, a compressible material is attached to a portion of less than all of the top surface.

In one arrangement, the adhesive associated with the bottom surface is an adhesive material that is integrally formed with a flexible sheet member. In such an arrangement, the adhesive material may include a bitumen containing material or rubberized material that has been formed into a sheet member. Further, the sheet member may include various additional layers and/or reinforcements in addition to the adhesive material. In another arrangement, the adhesive associated with the bottom surface is applied to the bottom surface of the sheet member. In such an arrangement, the sheet member may be formed of any appropriate material. Such materials may include, without limitation, plastics, papers and cloths.

In one particular arrangement, the bottom surface of the flexible sheet member includes first and second release sheets that respectively cover the first and second portions of the bottom surface that are adapted for adherence to the floor and wall surfaces.

The compressible material may be formed of any material that provides desired compressive qualities. Such materials may include, without limitation, open and closed cell foams. In any case, the compressible material is attached to a portion of the top surface of the sheet member. In one particular arrangement, the compressible is attached to the portion of the top surface that corresponds to the portion of the bottom surface that is adapted for attachment to the wall surface.

DETAILED DESCRIPTION OF INVENTION

Reference will now be made to the accompanying drawings, which at least assist in illustrating the various pertinent features of the present invention. In this regard, the following description is presented for purposes of illustration and description. Furthermore, the description is not intended to limit the invention to the form disclosed herein. Consequently, variations and modifications commensurate with the following teachings, and skill and knowledge of the relevant art, are within the scope of the present invention. The embodiments described herein are further intended to explain the best modes known of practicing the invention and to enable others skilled in the art to utilize the invention in such, or other embodiments and with various modifications required by the particular application(s) or use(s) of the present invention.

Figure 1:
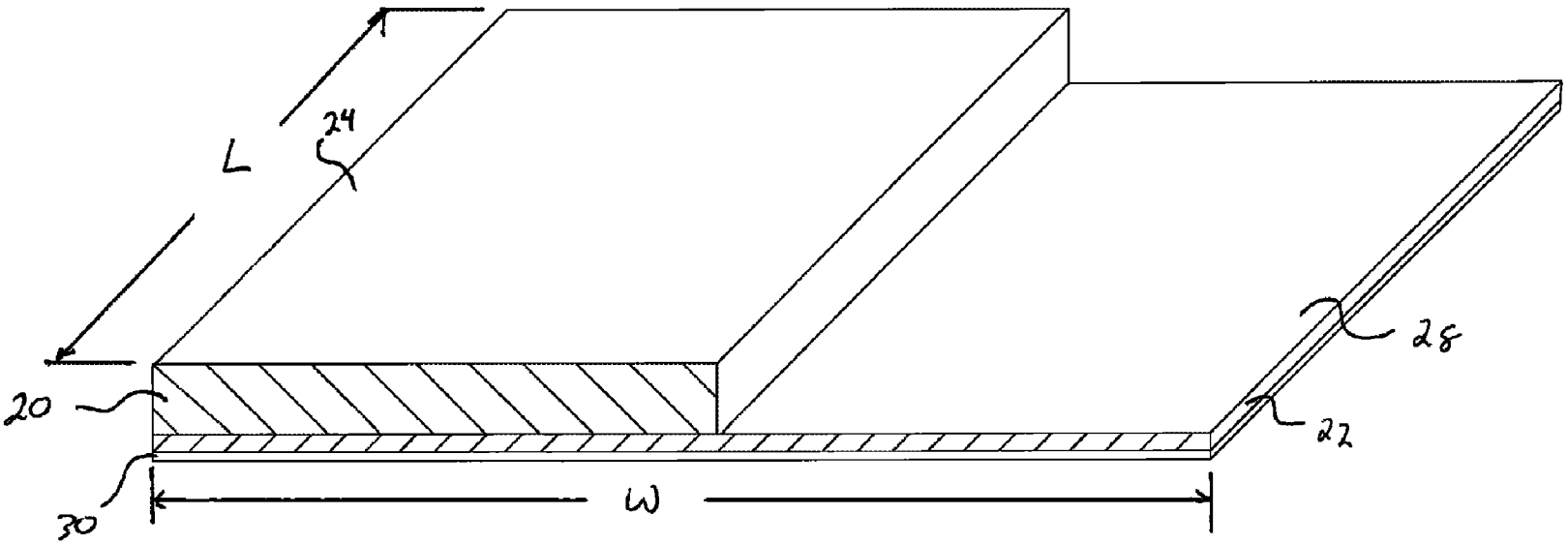
FIG. 1 illustrates a perspective view of a flexible expansion and sealing joint.
Figure 2:
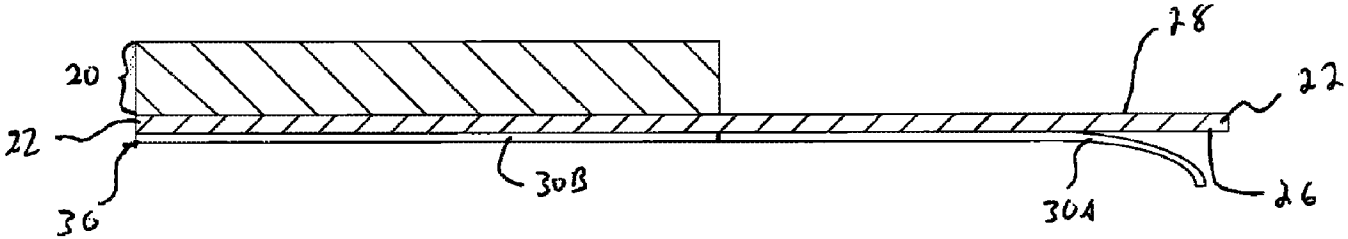
FIG. 2 illustrates a cross-sectional, side view of the flexible sealing and expansion joint of FIG. 1*a*.

One embodiment of the expansion and sealing joint 20 (hereafter "sealing joint") is now described in reference to FIGS. 1 and 2. In the illustrated embodiment, the flexible sealing joint 20 includes an adhesive sheet member 22 and the compressible member 24. The adhesive sheet member 22 includes a first or top surface 26 and a second or bottom surface 28. The bottom surface is an adhesive surface that allows the sheet member 22 to be adhered to a surface.

In the illustrated embodiment, the width of the compressible member 24 is bonded to a portion of the top surface 28 of the adhesive sheet member 22. However, the sheet member 22 need not extend across the entire width of the compressible member 24 so long as the resulting joint is able to seal an interface between a wall and a floor. A peel-away release sheet 30 may be interconnected to the bottom surface 26 adhesive sheet member 22 of the sealing joint 20 to prevent degradation of the adhesive qualities and/or prevent unintended adhesion of the adhesive sheet member 22 prior to use. In the illustrated embodiment, the peel-away release sheet 30 is removably interconnected to the entire bottom surface 26 of the adhesive sheet member 22. However, multiple separate peel-away release sheets may be interconnected to various portions of the flexible sealing joint 20, such as first and second portions of the bottom surface 26, as illustrated by separate release sheets 30A and 30B in FIG. 1B. As may be appreciated, the flexible sealing joint 20 may be of any width (W) and length (L) to facilitate sealing of an interface between a wall surface and a floor surface. Generally, the sealing joint 20 may be manufactured to have lengths between about 4 feet and about 12 feet and widths between about 3 inches and about 12 inches.

Figure 3:
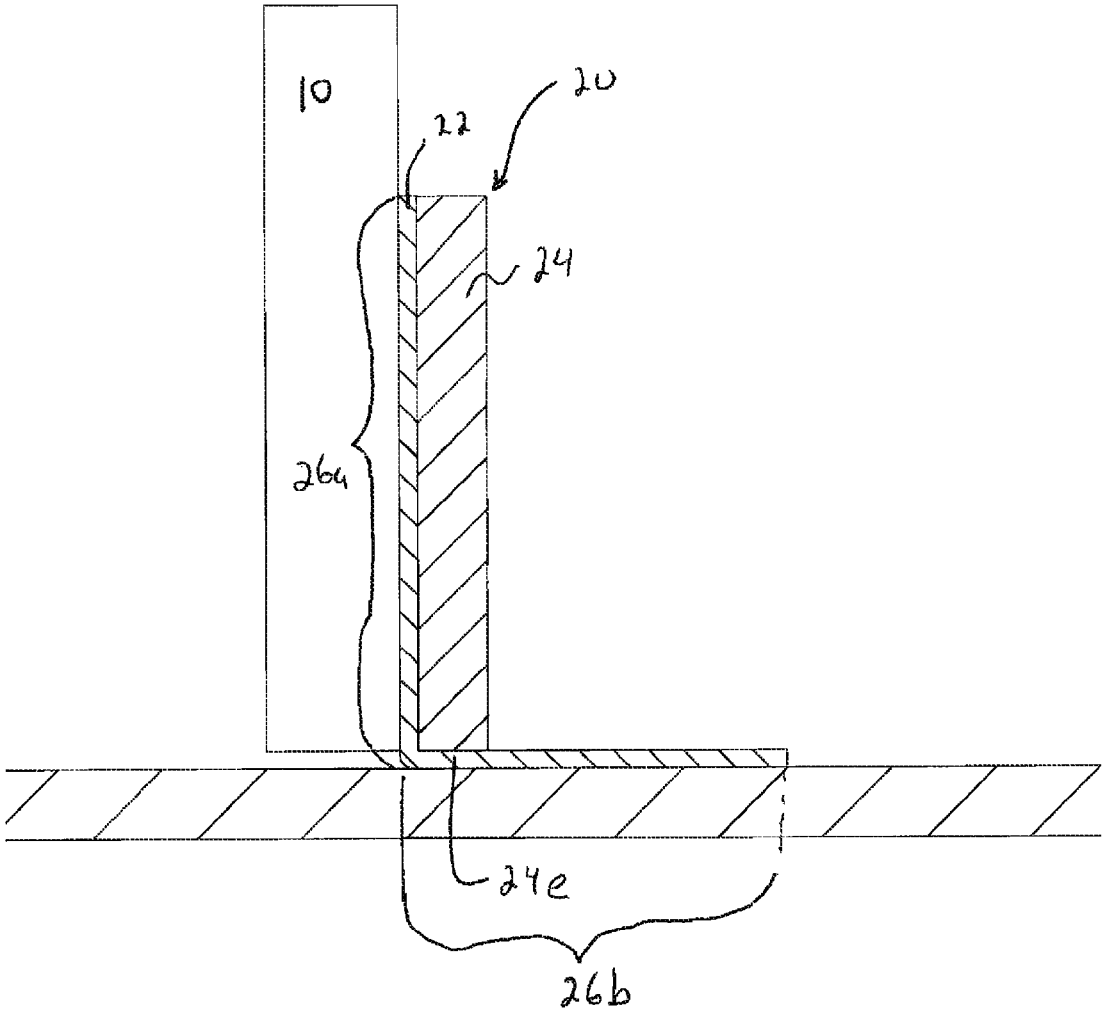
FIG. 3 illustrates a cross-sectional, side view of one arrangement of a flexible sealing joint of the present invention interconnected to a wall and floor.

FIG. 3 illustrates one arrangement of application of the sealing joint, to a wall 10 and a floor 14 in accordance with the present invention. As shown, the wall 10 and the floor 14 define an interface 16, which in some instances may include a gap that can allow a liquefied additive to seep therethrough. To prevent such seepage, the sealing joint 20 is adhered to a portion of the wall 10 and a portion of the floor 14 to seal the interface 16. In the present embodiment, separate portions of the adhesive sheet member 22 are adhered to the wall 10 and the floor 14. More particularly, a first portion 26A of the bottom surface 26 of the adhesive sheet member 22 is adhered to the wall 10 and a second portion 26B of the adhesive sheet member 22 is adhered to the floor 14. As adhered, the compressible member 24 is coincidental to the wall 10 and transverse to the floor 14 (e.g., substantially perpendicular to the floor 14). Thus, as adhered, the sealing joint 20 seals the interface 16 and restricts later applied liquefied flooring additives from flowing through the interface 16. Further, if an additive later solidifies, the compressible sheet member 24 facilitates expansion of the additive, thereby restricting damage to the wall 10 and/or flooring additive.

The adhesive sheet member 22 may include one or more adhesive materials that are applied to the surface of the sheet member 22 or that are integral to its manufacturer. In either use, the sheet members may be liquid impermeable to facilitate sealing of an interface. The sheet member 22 and adhesive materials should also be flexible to facilitate application of the adhesive sheet member 22 to both the wall 10 and floor 14. One adhesive material that may be utilized is a bitumen-containing material. Non-limiting examples of suitable bitumen-containing materials include various tar adhesives and rubberized asphalts, as well as certain butyl-rubber compounds (e.g., polyisobutylene). Various bitumen-containing adhesive materials are available from PROTECTO-WRAP CO., Denver, Colo., USA. However, it will be appreciated that a flexible sheet (e.g., plastic, cloth, etc.) having an adhesive applied to one or both surfaces may be utilized in other embodiments.

The adhesive sheet member 22 is typically an elongated rectangular sheet, although the shape and size may be dictated by application. The adhesive sheet member 22 should be of sufficient thickness to facilitates sealing of the interface 16 to prevent passage of a liquefied additive. The thickness of the adhesive sheet member 22 is generally related to the type of adhesive material(s) utilized and the sealing application. For example, in general residential construction applications, the adhesive sheet member 22 may, as noted, be formed of a bitumen compound and one or more reinforcing layers and may have a total thickness of about 20 mils.

The compressible sheet member 24 is typically formed from one or more compressible materials. For example, the compressible material(s) may be a foam (e.g., open or closed cell foams), plastics, or other polymeric materials material. The compressible member 24 may be any shape and size but, in the present embodiment, has a rectangular cross-sectional shape (See FIGS. 1 and 2). As shown, the compressible member 24 is attached to only a portion of the top surface 28 of the adhesive sheet member 22. This allows for placing the compressible member relative to the wall 10 and utilizing the remainder of the sheet member to engage an adjacent floor surface.

The peel-away release member 30 generally has a shape and size that corresponds with the shape and size of the adhesive sheet member 22 (e.g., a matching shape and size of the bottom surface 26 of the adhesive sheet member 22). The peel-away release member 30 typically includes one or more materials that are adapted to readily release from the adhesive sheet member 22 at a desired time. For example, the release material(s) may include foils, films, papers (e.g., wax paper) or other sheet materials. These release materials may be treated with silicon or other substances to provide a low level of adhesion to the adhesive sheet member 22. As noted above, multiple release sheet members 30A and 30B may be utilized. In such an arrangement, a single release sheet 30 may be applied to the bottom surface 26 and cut to produce separate release sheets 30A and 30B. Such separate release sheets 30A, 30B may allow for separately applying portions of the joint 20 to the floor 14 and wall 10.

Various methods useful in accordance with the present invention are now described with reference to FIGS. 1-4. One method generally includes the steps of removing (100) the peel-away release member 30 from the bottom surface 26 of the adhesive sheet member 22 and positioning (110) the sheet member 22 and/or orienting the compressible member 24 relative to at least one of the wall 10 and floor 14, and adhering (120) separate portions of the bottom surface 26 of the adhesive sheet member 22 to the wall 10 and to the floor 14. This allows the adhesive sheet 22 to seal the interface 16 between the wall 10 and the floor 14, while the compressible sheet member 24 is coincidental with the wall 10.

The positioning/orienting step (110) may be accomplished in a variety of manners. In one approach and with specific reference to FIG. 3, an end portion 24E of the compressible member 24 may be aligned with the surface of the floor 14. Thus, after the adhering step, at least a portion of the compressible member 24 is adjacent a portion of the adhesive sheet member 22 adhered to the floor 14, and at least a portion of the adhesive sheet member 22 is adjacent the wall 10. However, it will be appreciated that different approaches of completing the orienting step are within the scope and spirit of the present invention.

The adhering step (120) may also be accomplished in a variety of manners. For example, in conjunction with the removing (100) and positioning/orienting (110) steps, apportion 26B of the bottom surface 26 of the adhesive sheet 22 may be pressed onto the floor 14 to adhere that portion 26B of the flexible sealing joint 20 to the floor 14. A second release sheet may then be removed (130) from another. Likewise, portion 26A of the bottom surface 26 of the adhesive sheet member 22. This other portion 26A may then be pressed onto the wall 10 to adhere that portion 26A of the flexible sealing joint 20 to the wall 10, thereby sealing the interface 16 with the compressible sheet member 24 being coincidental to the wall. Other approaches of completing the adhering step are within the scope and spirit of the present invention.

The methods of the present invention may include other steps. For example, the method may further include steps directed to producing the sealing joint 20. Such production steps may include interconnecting the peel-away release member 30 to the bottom surface 26 the adhesive sheet member 22 and/or the step of interconnecting the compressible member 24 to a top surface 28 of the adhesive sheet 22. Either of these interconnecting steps may occur at a production facility. Correspondingly, any of the above-described removing, orienting and/or adhering steps may occur at a construction location, remote from the production location. In one embodiment, both of the above-described interconnecting steps occur at the production location and all of the above-described removing, orienting and adhering steps occur at the construction location. The step of interconnecting the compressible member 24 to a top surface 28 of the adhesive sheet member 22 may include contacting and compressing (e.g., between rollers) the compressible member 24 and the adhesive sheet member 22. This may bond the compressible member 24 to the top surface 28 of the adhesive sheet member 22. Thus, an integrated flexible joint 20 may be formed.

In another approach, the compressible member 24 may be interconnected (140) to the sheet member 22 at the construction location. In this regard, this interconnecting (140) may comprise the step of contacting the compressible sheet member 24 to the sheet member 22, before, after or concomitant with the adhering step (120). For instance, the sheet member 22 may be adhered (120) in place and a release liner may be removed from the top surface 28 of the sheet member 28 to allow adhering the compressible member 24 thereon.

The method may include other steps. For example, after a flexible sealing joint 20 is applied along a portion of the wall/floor interface, the method may include the step of applying another sealing joint 20 to the wall 10 and floor 14. This step may be completed when, for example, the length of the wall 10 and floor 14 requires more than one flexible sealing joint to seal the interface 16 between the wall 10 and floor 14. Thus, flow of flooring additives into the interface 16 may be restricted along the portion of wall 10 and floor 14 covered by adjacent sealing joints.

Figure 4:
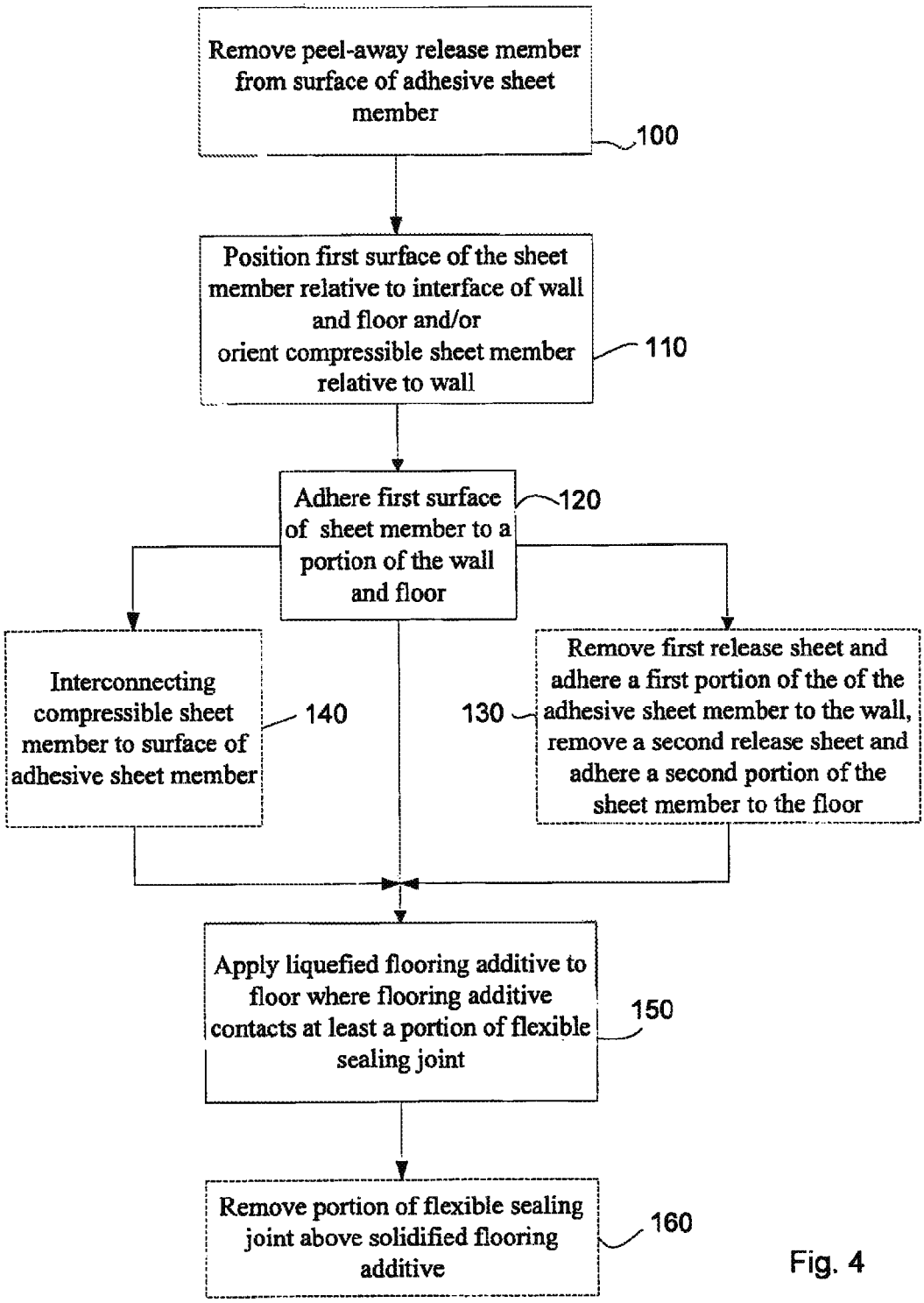
FIG. 4 is a flow chart illustrating various methods of the present invention.
Figure 5:
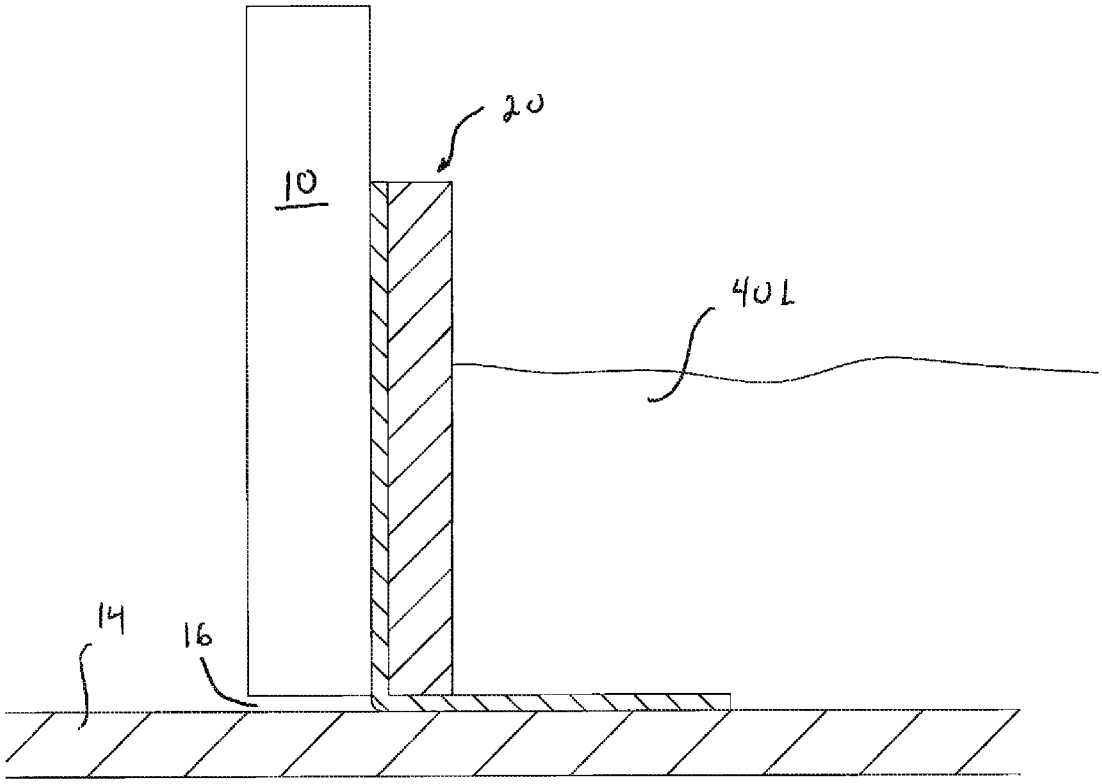
FIG. 5 illustrates a cross-sectional, side view of the arrangement of FIG. 3 with a liquefied flooring additive.

In another approach, and with reference to FIGS. 4 and 5, the method may include the step of applying (150) a liquefied additive 40L to the floor 14, once the sealing joint 20 is applied to the wall 10 and floor 14. In this regard, the liquefied additive may extend at least part way up the flexible sealing joint 20. As may be appreciated, the flooring additive 40L may be any liquid/near-liquid material used on flooring, such as self-leveling materials and the like, where it is desirable to restrict such additive from contacting or flowing into the interface 16 between the floor 14 and the wall 10.

Figure 6A:
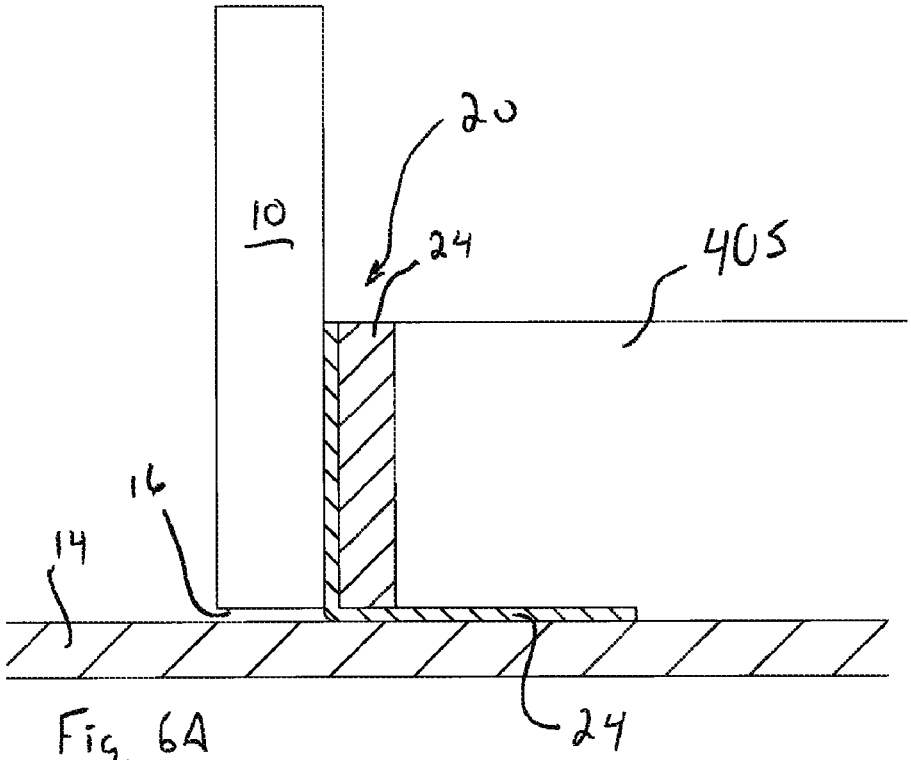
FIG. 6*a* illustrates a cross-sectional, side view of the arrangement of FIG. 5 with a solidified flooring additive.

In the case of self-leveling additives, the additives generally harden into a solid material 40S. See FIG. 6A. In some instances, it may be desirable to remove (160) portions of the flexible sealing joint 10 that extend above and/or just below the top surface of the hardened, solid additive 40S. In this regard, the method may include the step of severing a portion (not illustrated) of the flexible sealing joint 20 above the flooring additive 40S from a portion of the flexible sealing joint 20 below the flooring additive 40S. In some instances, after completing the severing step, the top surface of the flooring additive 40S and the top surface of the flexible sealing joint 20 may be substantially flush.

Figure 6B:
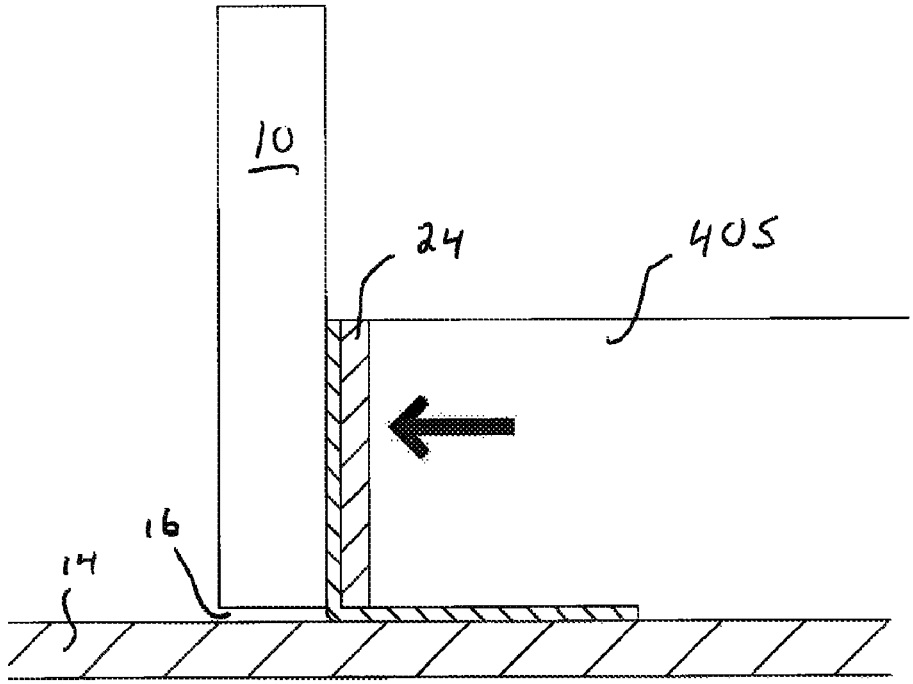
FIG. 6*b* illustrates a cross-sectional side view of the arrangement of FIG. 6*a* where the solidified flooring additive is expanded relative to FIG. 6*a*.

As shown in FIG. 6B, the compressible member 24 allows the solidified flooring additive 40S to contract and expand relative to the wall 10 and different rates. That is, the compressible member 24 of the flexible sealing joint 20 facilitates normal expansion of the solidified additive 40S, as indicated by arrow 42, and thus restricts damage to one or more of the wall 10, solid additive 40S and floor 14.

Further, the compressible member 24 provides an acoustic barrier between the solidified additive 40S and the wall 10. This barrier may reduce or substantially eliminate acoustic transmission between adjacent rooms having self-leveling floors. Thus, the flexible sealing joint 20 may have multiple functionality, including: (a) restricting flow of liquid flooring additives 40L into the interface 16 between the wall 10 and the floor 14 by sealing such interface 16; (b) restricting damage to the wall 10, the solid flooring additive 40S and/or the floor 14 by facilitating expansion of the solid flooring additive 40S; and (c) providing an acoustic barrier.

While various embodiments of the present invention have been described in detail, it is apparent that modifications and adaptations to those embodiments will occur to those skilled in the art. It is to be expressly understood, however, that such modifications and adaptations are within the scope of the present invention, as set forth in the claims below. Further, it should be recognized that any feature of any embodiment disclosed herein can be combined with any other feature of any other embodiment in any combination.

What is claimed is:

1. A method for forming an expansion joint and seal for a wall-floor interface, the method comprising:

removing a peel-away release member from a bottom surface of an adhesive sheet member;

orienting a compressible member relative to a wall, said compressible member being attached to a top surface of said adhesive sheet member across a first portion of a width of said adhesive sheet member; wherein said adhesive sheet member and said compressible sheet member define a flexible sealing joint;

adhering said bottom surface of said adhesive sheet member to a portion of said wall and to a portion of a floor, thereby sealing an interface between said wall and said floor, wherein as adhered, a) said compressible member is coincidental to said wall, and b) a second portion of the width of said adhesive sheet member, substantially free of said compressible member, is coincidental to said floor;

applying a liquid flooring additive to said floor after said adhering step, wherein as applied said liquid flooring additive covers said second portion of the width of the adhesive sheet member and contacts at least a portion of said compressible member; and after the liquid flooring additive solidifies, removing a portion of the compressible member above the surface of the solidified flooring additive.

2. A method as recited in claim 1, wherein, as adhered, a substantial entirety of said compressible member is adjacent to said wall.

3. A method as recited in claim 1, wherein as adhered, a substantial entirety of said compressible member is transverse to said floor.

4. A method as recited in claim 1, wherein said removing step comprises:

severing a first portion of said compressible member from a second portion of said compressible member, wherein, prior to said severing step, at least a portion of said first portion of said compressible member is located above said flooring additive.

5. A method for forming an expansion joint and seal for a wall-floor interface, the method comprising:

separating a release sheet from a first surface of an adhesive sheet member;

positioning the first surface of said adhesive sheet member relative to an interface of a wall and a floor;

adhering a first portion of said first surface to said floor and a second portion of said first surface to said wall, wherein a substantial entirety of a compressible sheet member is connected to a second surface of said adhesive sheet member on said second portion, and is substantially coincidental to said wall and substantially transverse to said floor, wherein said adhesive sheet member and said compressible sheet member define a flexible sealing joint;

applying a liquid flooring additive to said floor and over said flexible sealing joint after said adhering step such that said flexible sealing joint is generally disposed between a) said floor and said wall, and b) said liquid flooring additive, wherein as applied, said liquid flooring additive contacts at least a portion of said compressible member; and upon said liquid flooring additive solidifying, removing a portion of said flexible sealing joint above said liquid flooring additive that is substantially free of contact with said liquid flooring additive.

6. The method of claim 5, wherein separating a release sheet comprises removing a first release sheet associated with said first portion of said first surface and removing a second release sheet associated with said second portion of said first surface.

7. A method as recited in claim 1, wherein as adhered, a substantial entirety of said compressible member is parallel to said wall.

8. A method as recited in claim 1, wherein said first portion of said compressible member is substantially free of contact with said liquid flooring additive.

9. A method as recited in claim 1, wherein said applying step comprises:

distributing said liquid flooring additive over said flexible sealing joint such that said flexible sealing joint is generally disposed between a) said floor and said wall, and b) said liquid flooring additive.

10. The method of claim 5, wherein said portion of said flexible sealing joint above said liquid flooring additive that is substantially free of contact with said liquid flooring additive comprises a portion of said compressible member.

* * * * *